US007905299B2

(12) United States Patent
Wrede et al.

(10) Patent No.: US 7,905,299 B2
(45) Date of Patent: Mar. 15, 2011

(54) ARTICULATION ASSEMBLY FOR MOVING A DRILL MAST

(75) Inventors: Stefan Wrede, Kirchhundem (DE); Christof Kruse, Wenden (DE)

(73) Assignee: Longyear TM, Inc., South Jordan, UT (US)

( * ) Notice: Subject to any disclaimer, the term of this patent is extended or adjusted under 35 U.S.C. 154(b) by 202 days.

(21) Appl. No.: 12/233,363

(22) Filed: Sep. 18, 2008

(65) Prior Publication Data

US 2010/0065335 A1 Mar. 18, 2010

(51) Int. Cl.
*E21B 3/02* (2006.01)
*E21B 15/04* (2006.01)

(52) U.S. Cl. ..... 175/113; 175/220

(58) Field of Classification Search ..... 175/113, 175/202, 220, 45; 173/184–188, 193, 28, 173/27, 189

See application file for complete search history.

(56) References Cited

U.S. PATENT DOCUMENTS 3,809,344 A * 5/1974 Kolderup et al. ..... 173/185
4,858,700 A 8/1989 Shafer
5,794,721 A * 8/1998 Clonch et al. ..... 175/45
5,794,723 A 8/1998 Caneer, Jr. et al.
6,186,248 B1 2/2001 Silay et al.
2003/0047359 A1 3/2003 Shupe
2006/0042811 A1 * 3/2006 Hagemeyer ..... 173/1

FOREIGN PATENT DOCUMENTS

JP 07-139284 A 5/1995

OTHER PUBLICATIONS

International Search Report and Written Opinion dated Feb. 26, 2010 as issued in International Application No. PCT/US2009/057076 filed Sep. 16, 2009.

* cited by examiner

*Primary Examiner* — David J Bagnell
*Assistant Examiner* — James G Sayre
(74) *Attorney, Agent, or Firm* — Workman Nydegger

(57) ABSTRACT

A jib assembly for use with a drill rig includes a jib boom having a first end and a second end. The jib boom is to rotate about the first end and the second end is configured to be coupled to a mast assembly mount. The jib assembly also includes an articulation assembly having at least one variable length link having a first end and a second end. The first end of the variable length link is offset from the jib boom and the second end is configured to be pivotingly coupled to the mast assembly mount.

26 Claims, 7 Drawing Sheets

ARTICULATION ASSEMBLY FOR MOVING A DRILL MAST

BACKGROUND OF THE INVENTION

1. The Field of the Invention

The present invention relates to drilling equipment and to articulation assemblies for positioning a drill mast in particular.

2. The Relevant Technology

Drilling rigs are often used for drilling holes into various substrates. Such drill rigs include a drill head or drifter or both together as a double head system mounted to a mast assembly that is oriented at a desired drilling angle. The rig often includes mechanisms and devices that are capable of moving the drill head along at least a portion of the mast. The drill head often further includes mechanisms that receive and engage the upper end of a drill rod. The drill rod may be a single rod or a casing and rod combination as an overburden system or may be part of a drill string that includes a cutting bit or other device on the opposing end, which may be referred to as a bit end. In the case of a drill string, the drill string may include multiple rods, each of which has a length that is shorter than the usable length of the mast.

The drill head also applies one or more forces to the drill rod which is transmitted to the drill to string. If the applied force is a rotational force, the drill head may thereby cause the drill string rotate within the bore hole. The rotation of the drill string may include the corresponding rotation of the cutting bit, which in turn may result in a cutting action by the drill bit. The forces applied by the drill head can also include axial thrust forces, which may be transmitted to the drill string to facilitate penetration into the formation at the desired drilling angle.

Articulation assemblies are often provided on the drill rig to orient the drill mast at the desired angle. Such articulation assemblies often include a jib assembly that is configured to raise, lower, and tilt the mast assembly. In particular, jib assemblies often include a jib boom that supports the mast assembly. The jib boom is often raised and lowered by a lifting cylinder. A tilting cylinder is also often mounted directly to the jib boom on one end and coupled to the mast assembly on the other end. The tilting cylinder is extended and retracted in order to orient the mast assembly at a desired angle.

While such articulation assemblies are able to orient the mast assembly, the configuration of the articulation assemblies are often such that raising and lowering the mast assembly changes the drilling angle. Accordingly, in drilling operations where multiple holes are drilled at the same drilling angle, after one hole has been drilled the lifting cylinder is deployed to raise the mast assembly, the rig is moved to a new drilling location, the mast assembly is lowered, and the tilting cylinder is deployed to return the mast assembly to the appropriate drilling angle. Resetting the drilling angle each time can increase down time, thereby increasing the cost of the drilling operation.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

In at least one example, a jib assembly for use with a drill rig includes a jib boom having a first end and a second end.

The jib boom is configured to rotate about the first end and the second end is configured to be coupled to a mast assembly mount. The jib assembly also includes an articulation assembly having at least one variable length link having a first end and a second end. The first end of the variable length link is offset from the jib boom and the second end is configured to be pivotingly coupled to the mast assembly mount.

A jib assembly can also include a jib boom having a first end configured to be coupled to a mount and a second end configured to be coupled to a mast assembly mount. The jib assembly can also include an articulation assembly having at least one variable length link that is maintained parallel to a line between the first end and the second end of the jib boom.

Further, an assembly for positioning a drill mast is provided that can include a mast assembly mount, a jib boom having a first end coupled to a mount and a second end coupled to the mast assembly mount. A jib lifter is configured to rotate the jib boom about the first end. A jib articulation assembly can include a variable length link having a first end offset from the jib boom and a second end coupled to the mast assembly mount such that the variable length link is parallel to a line between the first end and the second end of the jib boom as the jib lifter rotates said jib boom about the first end of the jib boom.

A drilling system can include a mast and a jib assembly coupled to the rig. The jib assembly can include a mast assembly mount, a jib boom having a first end coupled to a mount and a second end coupled to the mast assembly mount. A jib lifter is configured to rotate the jib boom about the first end. A jib articulation assembly can include a variable length link having a first end offset from the jib boom and a second end coupled to the mast assembly mount such that the variable length link is parallel to a line between the first end and the second end of the jib boom as the jib lifter rotates said jib boom about the first end of the jib boom. The drilling system can further include a mast coupled to the mast assembly mount and a drill head coupled to the mast.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

Figure 1A:
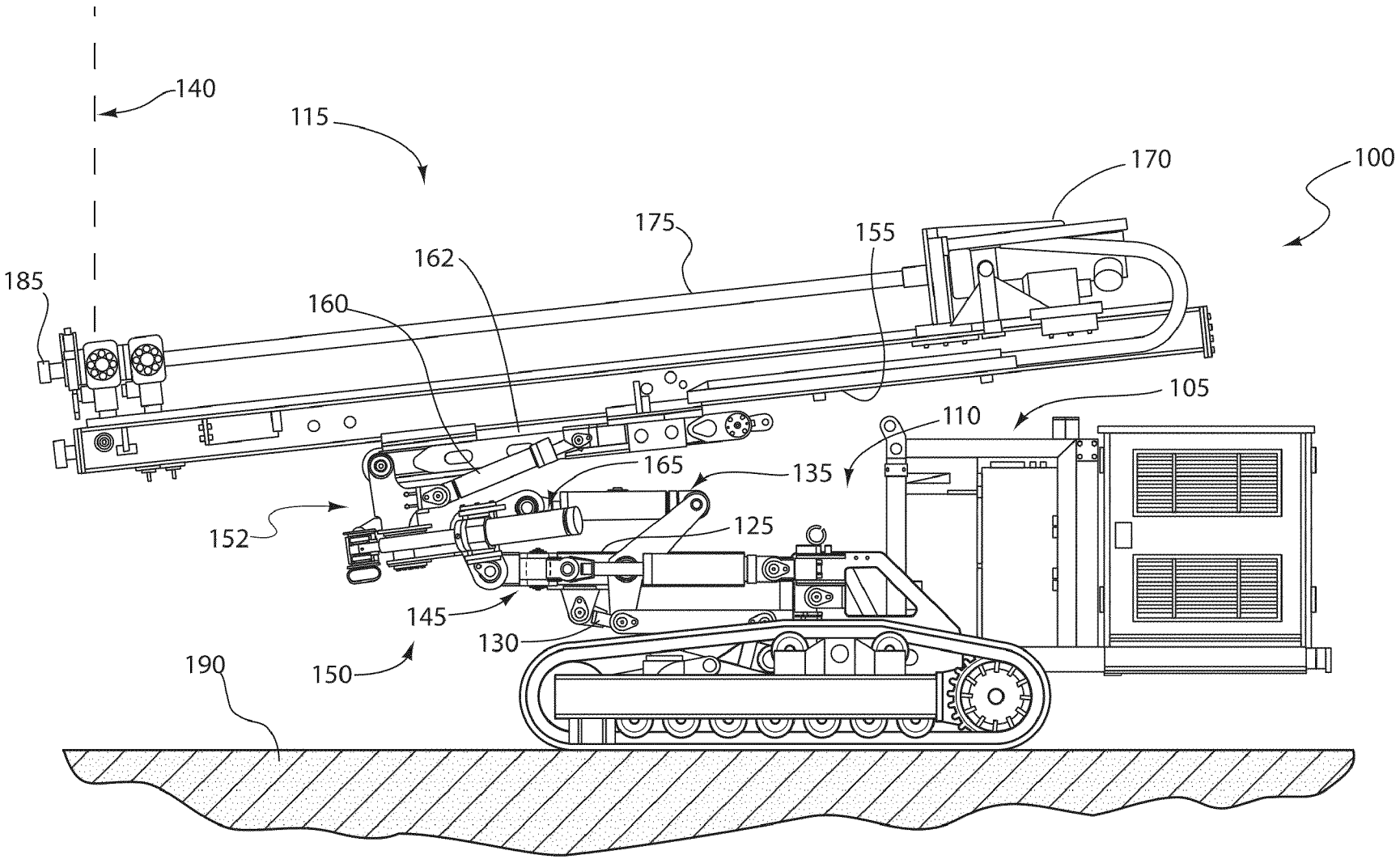
FIG. 1A illustrates a drilling system in which the mast assembly is oriented in a transport position.

Together with the following description, the figures demonstrate non-limiting features of exemplary devices and methods. The thickness and configuration of components can be exaggerated in the Figures for clarity. The same reference numerals in different drawings represent similar, though necessarily identical, elements.

DETAILED DESCRIPTION OF THE PREFERRED EMBODIMENTS

Articulation assemblies, jib assemblies, and drilling systems are provided herein that are configured to maintain a mast assembly at a drilling angle as the mast is raised and lowered. The mast may be raised and lowered to allow the drilling rig or drilling system to be moved. Accordingly, the drilling angle may be maintained as the drilling system or rig is moved between drilling locations on a job site where the same drilling angles are being used. The articulation assembly can provide a relatively high pull-back torque, which may allow the articulation assembly to readily move the mast assembly to a transport position out of an extreme position in the front. Further, the configuration of the articulation assembly may reduce the possibility that the drill mast will be over-rotated, thereby increasing the stability of the drilling system.

For ease of reference, the term "link" shall be broadly understood to mean a kinematic link, such as a line between points about which the link moves, such as the points about which the link rotates, regardless of the perimeter shape or other configuration of the link. The following description supplies specific details in order to provide a thorough understanding. Nevertheless, the skilled artisan would understand that assemblies and associated systems can be implemented and used without employing these specific details.

FIG. 1A illustrates a drilling system 100 that includes a rig 105, a jib assembly 110 and a mast assembly 115 in which the mast assembly 115 is positioned and oriented for transport. The jib assembly 110 can be coupled to a support structure, such as the rig 105. For example, the jib assembly 110 can be coupled to a rig 105 or the jib assembly 110 may be provided as an integral part of the rig 105.

The mast assembly 115 is coupled to and supported by the jib assembly 110. The mast assembly 115 is further positioned and oriented by the jib assembly 110. The jib assembly 110 generally includes a jib boom 125 that is raised and lowered by a jib lifter 130, such as a lift hydraulic cylinder. The jib assembly 110 also includes a jib articulation assembly 135 that is configured to control the orientation of the mast assembly 115. The orientation of the mast assembly 115 may be described relative to a generally vertical axis 140.

The jib assembly 110 can include a jib slewing assembly 145 configured to move the jib boom 125 in a plane that is generally perpendicular to the vertical axis 140. Such plane may be generally referred to as a horizontal plane. Accordingly, the jib boom 125 can be positioned by the jib lifter 130 and the jib slewing assembly 145. The orientation of the mast assembly 115 can be controlled by the jib articulation assembly 135. As illustrated in FIG. 1, the jib articulation assembly 135 includes at least one variable length link that is offset from the jib boom 125. Such a configuration can allow the jib lifter 130 and the jib slewing assembly 145 to vary the position of the jib boom 125 while the jib articulation assembly 135 controls the orientation of the mast assembly 115 relative to the jib assembly 110. In at least one example, the variable link can be generally parallel to the jib boom 125 in a kinematic sense.

The jib articulation assembly 135 can also maintain the orientation of the mast assembly 115 relative to the vertical axis 140 as the mast assembly 115 is moved as described above. Maintaining the orientation of the mast assembly 115 relative to the vertical axis 140 can describe the orientation of the entire mast assembly 115 or of specific components. In at least one example, the orientation of various components of the mast assembly 115 can be varied within the mast assembly 115. In other examples, the orientation of components within the mast assembly 115 can be relatively fixed. For ease of reference, an example in which the components within the mast assembly 115 can be varied will be discussed below.

As illustrated in FIG. 1A, the mast assembly 115 can include a mast assembly mount 150 that is coupled to the jib assembly 110. In the illustrated example, the jib articulation assembly 135 is coupled to the mast assembly mount 150 in such a manner that one or more of the links of the jib articulation assembly 135 can be varied to control the orientation of the mast assembly mount 150. For ease of reference, movement of the mast assembly 115 will be described relative to the jib assembly 110 while movement of other components within the mast assembly 115 will be described relative to the mast assembly mount 150.

The mast assembly mount 150 is configured to support a mast carrier 152, which in turn can be configured to support a mast 155. A mast tilt cylinder 160 can also be coupled to the mast carrier 152 to lift the mast 155. The mast assembly 115 can further include a mast slewing assembly 165. The mast slewing assembly 165 can be supported by the mast assembly mount 150 and coupled to the mast carrier 152. Such a configuration can allow the mast slewing assembly 165 to rotate the mast carrier 152 relative to the mast assembly mount 150. In at least one example, the mast 155 can be configured to translate relative to the mast carrier 152. In particular, a translation cylinder (not shown) can be coupled to both the mast carrier 152 and the mast 155 such that extension and retraction of the mast carrier 152 causes the mast 155 to translate relative to the mast carrier 152. Such a configuration can allow the translation cylinder to selectively press the mast 155 to the ground to provide additional stability for the drilling system, and the jib assembly 110 and jib articulation assembly 135 in particular, during the drilling process.

As will be described in more detail below, the jib assembly 110 and the mast assembly 115 are configured to orient and position the mast 155. The jib articulation assembly 135 is configured to maintain the orientation of the mast 155 as the mast 155 is raised and lowered.

Figure 1B:
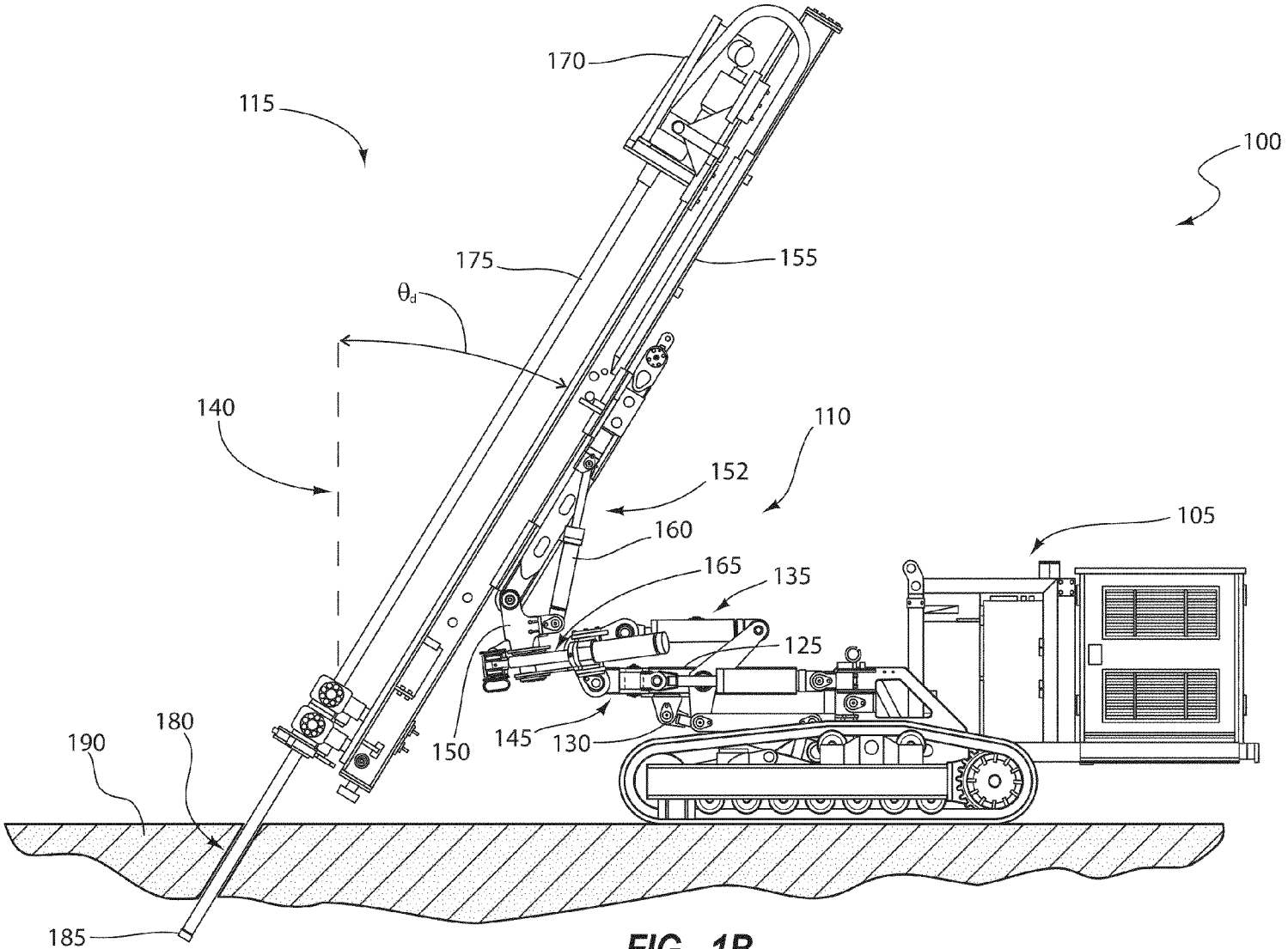
FIG. 1B illustrates the drilling system of FIG. 1A in which the mast assembly is positioned and oriented at a drilling angle during a drilling operation.

A drill head 170 can be operatively associated with the mast 155. As illustrated in FIG. 1B, the jib assembly 110 and the mast assembly 115 can cooperate to move the mast carrier 152, and the mast 155 in particular, into a drilling position. As further illustrated in FIG. 1B, the drill head 170 is configured to have a drill rod 175 coupled thereto. The drill rod 175 can in turn be coupled to additional drill rods to form a drill string 180. In turn, the drill string 180 can be coupled to a drill bit 185 configured to interface with the material to be drilled, such as a formation 190.

In at least one example, the drill head 170 illustrated in FIG. 1 is configured to rotate the drill string 180 during a drilling operation. In particular, the rotational rate of the drill string 180 can be varied as desired during the drilling operation. Further, the drill head 170 can be configured to translate relative to the mast 155 to apply an axial force to the drill head 170 to urge the drill bit 185 into the formation 190 during a drilling process.

The orientation of the mast 155 relative to the vertical axis 140 helps determine the direction the drill string 180 takes as it travels through the formation 190. The orientation of the mast 155, and consequently the orientation of the drill string 180 as it enters the formation 190 may be described as a drilling angle and may be referenced relative to any arbitrary axis, such as the vertical axis 140. In the illustrated example, the mast 155 can be moved to a drilling angle $\theta_d$ (theta sub-d) by varying the lengths of one or more links of the jib articulation assembly 135 and/or varying the length of the mast tilt cylinder 160.

Figure 1C:
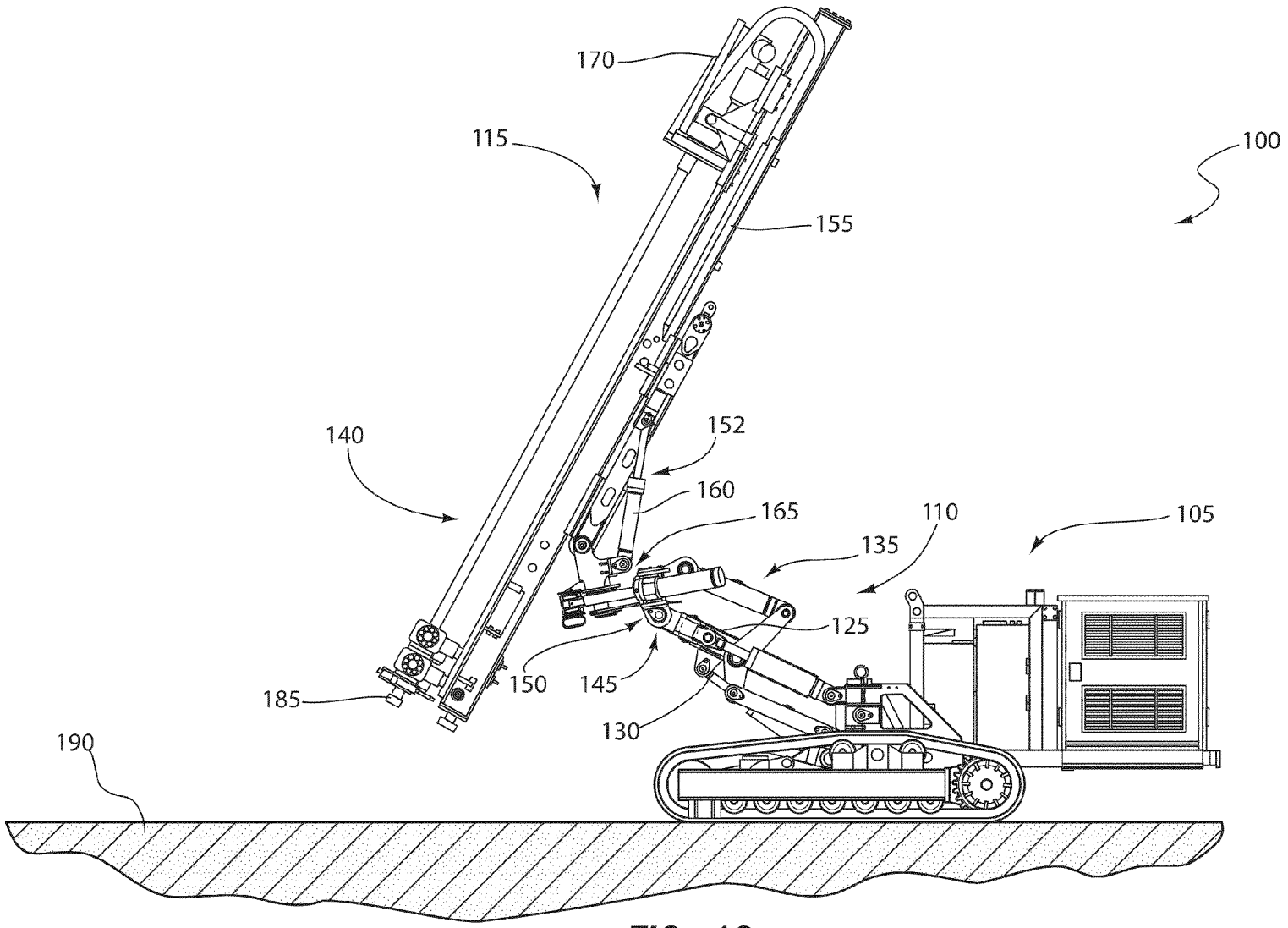
FIG. 1C illustrates the drilling system of FIGS. 1A and 1B in which the mast assembly is raised while maintaining the mast assembly at the drilling angle.
Figure 2A:
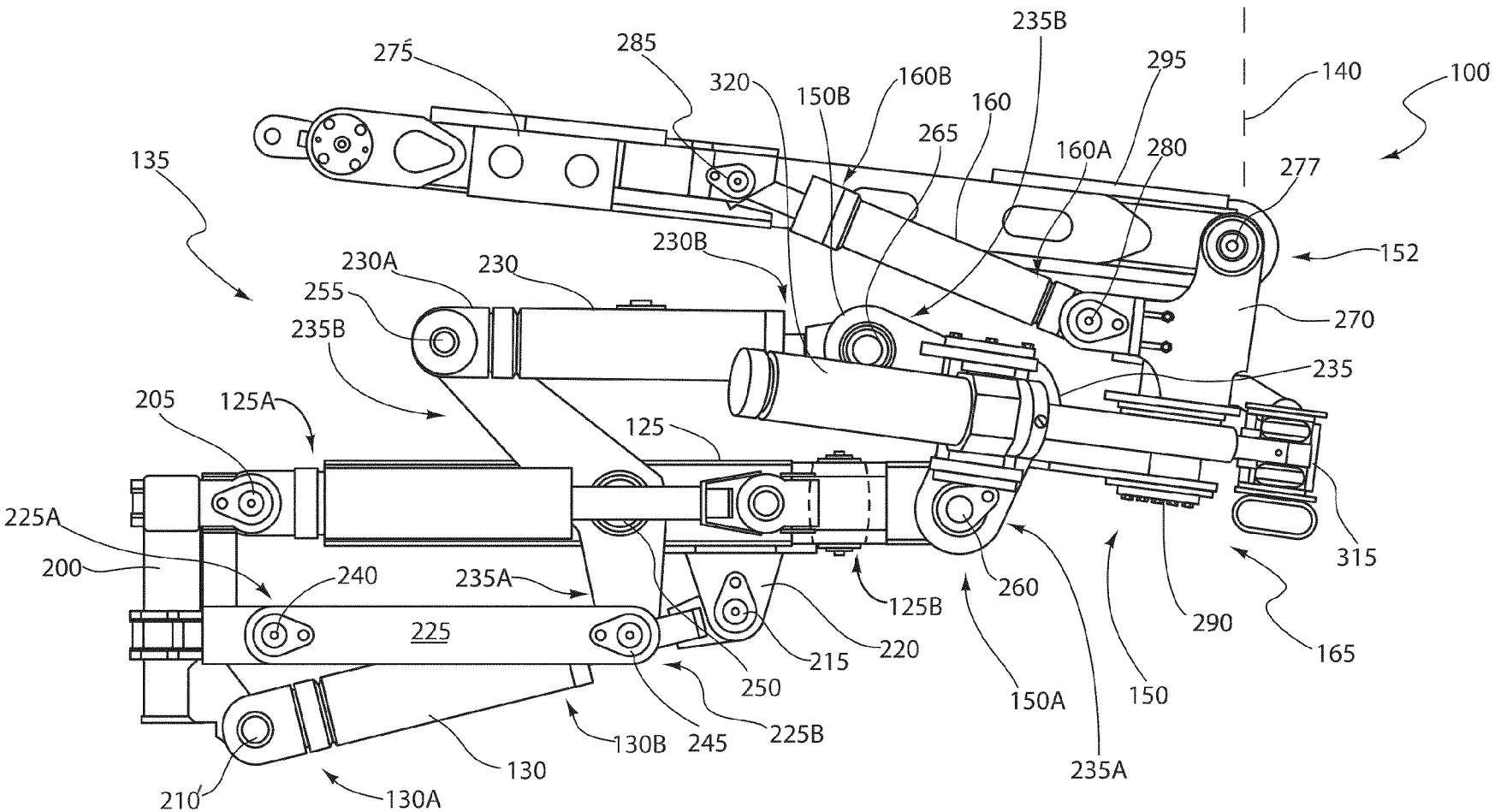
FIG. 2A illustrates a jib assembly and portions of a mast assembly in which the mast assembly is oriented in a transport position.

In FIG. 1B, the mast assembly 115 is shown positioned in proximity with the formation 190 and the mast 155 is oriented at a drilling angle $\theta_d$. As previously introduced, the jib articulation assembly 135 is configured to raise and lower the mast assembly 115 while maintaining the mast assembly 115 at the drilling angle $\theta_d$. Such a configuration is illustrated in FIG. 1C, in which the jib lifter 130 has been operated to raise the mast assembly 115 away from the formation 190 while the jib articulation assembly 135 maintains the mast assembly 115 at the desired drilling angle $\theta_d$. Accordingly, the jib articulation assembly 135 is configured to maintain the mast assembly 115 in a desired orientation as the mast assembly 115 moves. Accordingly, using the jib boom articulation 135 to the mast assembly 115 to the desired angle $\theta_d$, the drilling can be maintained constant without changing the length of the links of the jib boom articulation assembly, such as changing the stroke of the tilt cylinder 230 (FIG. 2A). Such a configuration can allow the drilling system 100 to adjust a higher drilling position while maintaining the same drilling angle. This phenomenon is creating by the link 225 and 235 (FIG. 2A).

The rig 105 illustrated is provided for ease of reference only. It will be appreciated that the rig 105 can have any configuration, such as a wheeled rig, a tracked rig, some combination thereof, or any other type of rig. Further, in the illustrated example, the mast 155 can be positioned/or oriented with the mast tilt cylinder 160 and mast slewing assembly 165. In other examples, the mast 155 can be fixedly mounted to the mast mount 150 such that the jib articulation assembly 135 controls the position and orientation of the mast 155. In still other examples, the mast assembly 115 can include more or less positioning and/or orienting components than those described above. Further, while a rotary type drill head is illustrated, it will be appreciated that any type of drill head can be coupled to any type of mast, including percussive, sonic, or any other type of drill head. Further, any number of drill heads can be operatively associated with the drill mast.

Figure 2B:
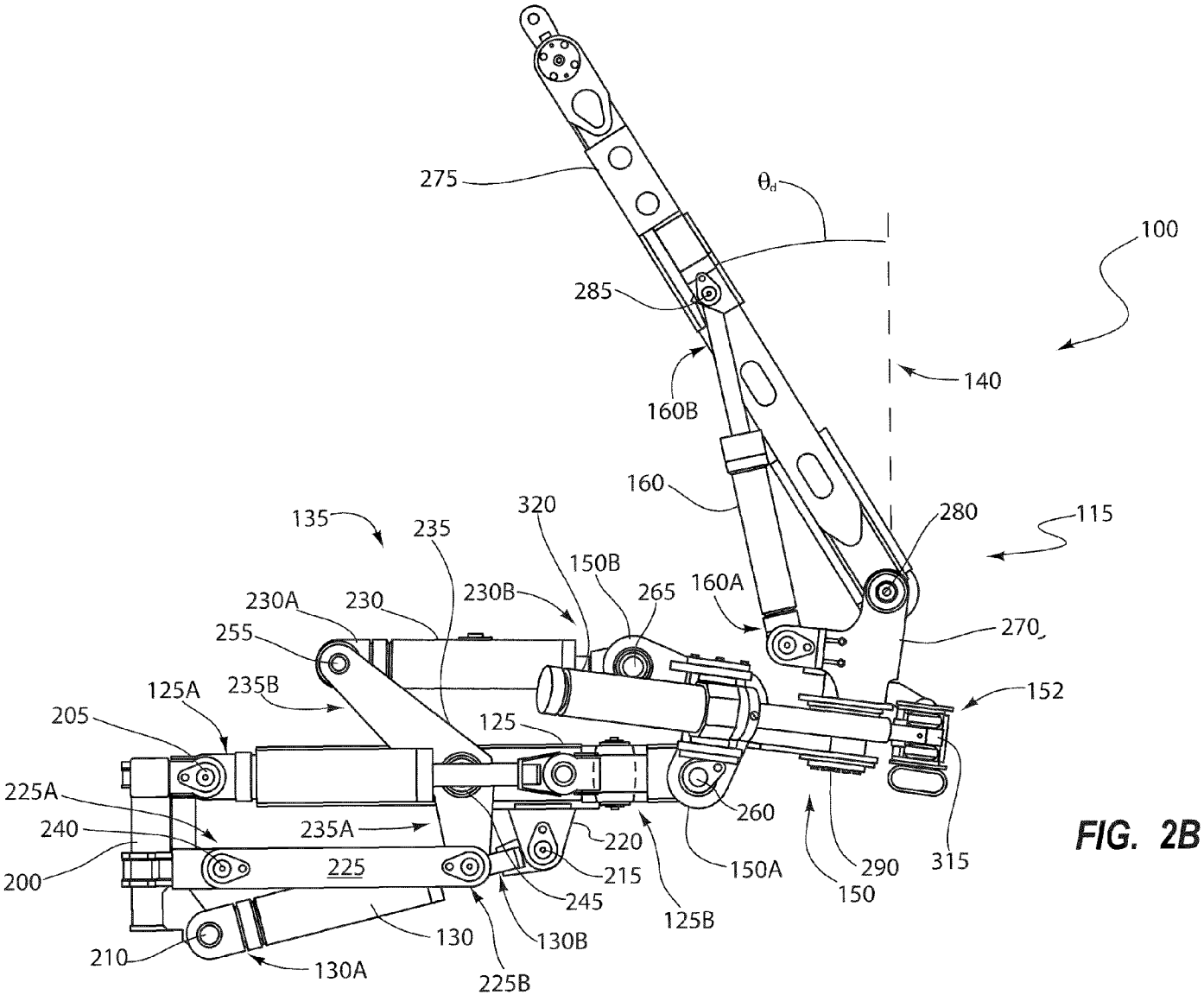
FIG. 2B illustrates the jib assembly and mast assembly of FIG. 2A in which the mast assembly is positioned and oriented at a drilling angle.
Figure 2C:
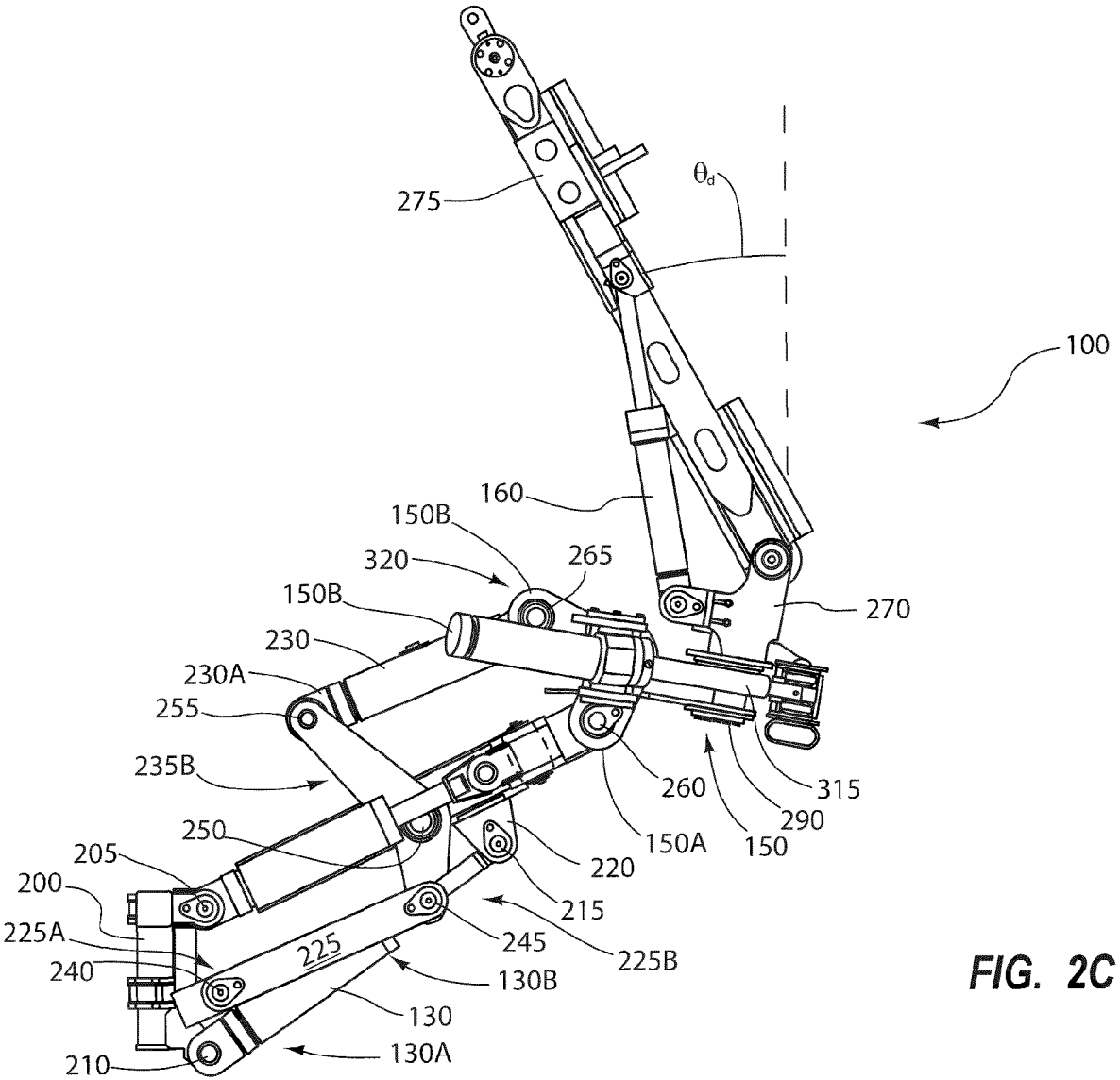
FIG. 2C illustrates the articulation assembly and mast assembly of FIGS. 2A and 2B in which the mast assembly is raised relative to the position shown in FIG. 2B.

FIGS. 2A-2C illustrate elevation views of the jib assembly 110 and part of a mast assembly including the mast mount 150, the mast carrier 152, and the mast slewing assembly 165 in more detail. In particular, FIGS. 2A-2C illustrate these components in analogous positions as those illustrated with respect to the drilling system 100 in FIGS. 1A-1C respectively.

Figure 3:
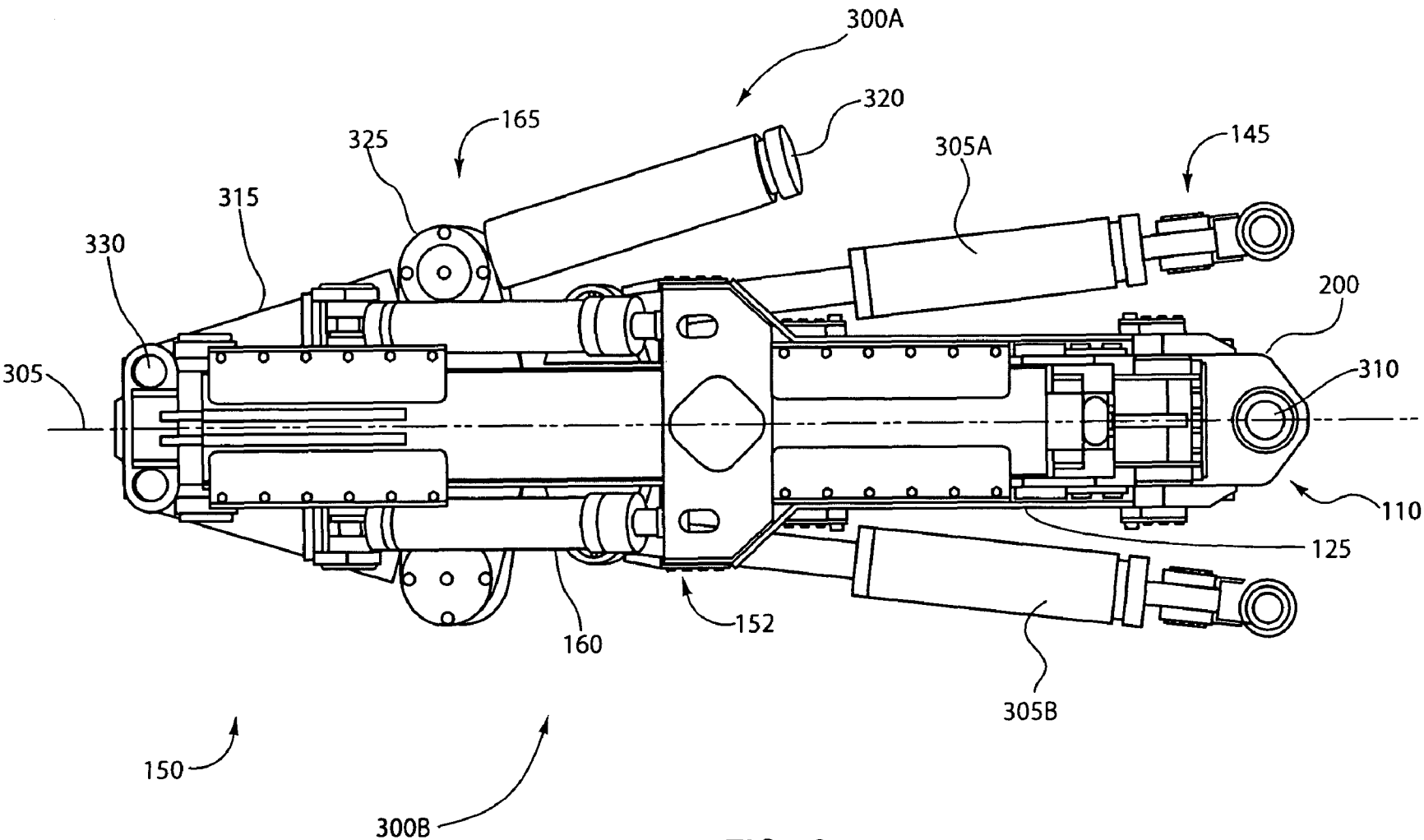
FIG. 3 illustrates a plan view of an articulation assembly and a mast assembly according to one example.

FIG. 3 illustrates a plan view of the jib boom assembly 110, mast carrier 152, mast tilt cylinder 160, and mast slewing assembly 165 in more detail. In at least one example, the jib assembly 110 and mast carrier 152 may include two halves 300A and 300B that are generally symmetric about a plane represented by line 305. For ease of reference, the components of half 300A will be described with reference to FIGS. 2A-2C. It will be appreciated that the same discussion may also be applicable to the components of half 300B. A discussion of the operation of the jib assembly 110 and the mast tilt cylinder 160 to orient the mast carrier 152 relative to the vertical axis 140 will first be discussed followed by a discussion of the operation of the jib slewing assembly 145 and the mast slewing assembly 165 to position the mast carrier 152 relative to a horizontal plane.

Turning again to FIG. 2A, the jib assembly 110 includes a jib mount 200 that is configured to be coupled to a base structure, such as the drill rig 105 (FIGS. 1A-1C). The jib boom 125 is configured to be coupled to the jib mount 200. In particular, the jib boom 125 includes a first end 125A that is coupled to the jib mount 200 by a pivot 205. A second end 125B of the jib boom 125 can be coupled to the mast assembly mount 150, as will be described in more detail later. The jib lifter 130 can also be coupled to the jib mount 200 as well as the jib boom 125 such that a first end 130A of the jib lifter 130 is coupled to the jib mount 200 by a pivot 210.

The second end 130B of the jib lifter 130 is coupled to the jib boom 125 such that as the jib lifter 130 is extended and retracted, the jib lifter 130 raises and lowers the jib boom 125. For example, a pivot 215 can couple the second end 130B of the jib lifter 130 to the jib boom 125 near the second end 125B. In the example shown, the pivot 215 is coupled to an offset mount 220 such that the second end 130B of the jib lifter 130 is offset from the jib boom 125.

The jib articulation assembly 135 illustrated includes a lower link 225 and an upper link 230 that are coupled by a pivoting link 235. A first end 225A is pivotingly coupled to the jib mount 200 by a pivot 240 while a second end 225B is pivotingly coupled to a first end 235A of the pivoting link 235 by pivot 245.

The pivoting link 235 can also be coupled to the jib boom 125, such as by pivot 250. The second end 235B of the pivoting link 235 can be further coupled to a first end 230A of the upper link 230, such as by a pivot 255. The second end 230B of the upper link 230 can be coupled to the mast assembly mount 150. In particular, the mast assembly mount 150 can include a plurality of arms 150A and 150B.

In the illustrated example, a second end 125B of the jib boom 125 is coupled to arm 150A by pivot 260 while the second end 230B of the upper link 230 is coupled to arm 150B by pivot 265. The orientation of the mast assembly mount 150 depends, at least in part, on the relative positions of the arms 150A and 150B. In at least one example, the mast assembly mount 150 may be rigid, such that movement of arm 150A results in a proportionate movement of the other arm 150B and vice versa. Accordingly, orientation of the mast assembly mount 150 depends on the relative positions of the arms 150A and 150B, which in turn depends, at least in part, on movement of the jib boom 125 and the jib articulation assembly 135.

As will be discussed in more detail below, the orientation of the arms 150A and 150B can be maintained relatively constant as the jib boom 125 is raised and lowered. Operation of the mast tilt cylinder 160 will first be discussed in the context of moving the mast assembly 115 from the transport position. Thereafter, operation of the jib articulation assembly 135 and the mast tilt cylinder 160 will be discussed in the context of establishing an orientation of the mast carrier 152, followed by a discussion on the interaction of the jib articulation assembly 135, the jib boom 125, and the mast assembly mount 150 as the jib boom 125 is raised.

As illustrated in FIG. 2A, the mast slewing assembly 165 can be mounted to the mast assembly mount 150. The mast carrier 152 in turn can be coupled to the mast slewing assembly 165. Operation of the mast slewing assembly 165 will be described in more detail with reference to FIG. 3. Continuing with reference to FIG. 2A, the mast carrier 152 generally includes a base portion 270 coupled to the mast slewing assembly 165. A platform 275 is pivotingly coupled to the base 270 by pivot 277.

The mast tilt cylinder 160 is coupled to the base portion 270 and the platform 275 in such a manner that as the mast tilt cylinder 160 is extended and retracted, the platform 275 is raised and lowered. In at least one example, the mast tilt cylinder 160 is a hydraulic cylinder that includes a first end 160A pivotingly coupled to the base 270 by a pivot 280 and a second end 160B pivotingly coupled to the platform 275 by pivot 285. Accordingly, the platform 275 can be raised by extending the mast tilt cylinder 160 to rotate the platform 275 as well as any components coupled thereto about the pivot 277 to the transport position illustrated in FIG. 2A toward a drilling position. In at least one example, the translation cylinder previously discussed (but not shown) can be coupled to one or more mounts 295. The mast 155 (FIGS. 1A-1C) can be in turn coupled to the mounts 295 such that extension or retraction causes the mounts 295, and thus the mast 155 (FIGS. 1A-1B) to translate relative to the platform 275.

FIG. 2B illustrates the mast carrier 152 in a raised position to orient the platform 275 at a desired angle relative to the vertical axis 140. The orientation of the platform 275 can be further varied by further operation of the mast tilt cylinder 160 or by operation of the jib articulation assembly 135. Operation of the jib articulation assembly 135 changes the orientation of the entire mast assembly 115 and thus the orientation of the mast tilt cylinder 160 as well. As previously introduced, the jib articulation assembly 135 includes at least one link having a variable length. In the example illustrated, the upper link 230 is the variable length link. It will be appreciated that the lower link 225 can have a variable length or a fixed length. Accordingly, either or both of the lower link 225 and the upper link 230 can have a variable length. Other links may also have variable lengths as desired.

The upper link 230 can have any configuration desired to provide a variable length. In the illustrated example, the upper link 230 is a hydraulic cylinder that is configured to extend and retract to vary the length of the upper link 230. As previously introduced, arm 150A is coupled to the second end 125B of the jib boom by pivot 260. Accordingly, extending the upper link 230 causes arm 150B to rotate relative to arm 150A about pivot 260, thereby varying the orientation of the mast assembly 115 relative to the vertical axis 140.

As previously introduced, the jib boom 125 can be raised and lowered by the jib lifter 130. In particular, the jib lifter 130 extends and retracts to rotate the jib boom 125 about pivot 205. Movement of the jib boom 125 due to rotation about pivot 205 includes both vertical and horizontal components. Accordingly, as the jib boom 125 rotates to the position illustrated in FIG. 2C, movement of the second end 125B includes both an upward component and a horizontal component. The horizontal component of rotating the jib boom 125 from the position in FIG. 2B to the position in FIG. 2C is directed toward the jib mount 200.

The jib articulation assembly 135 is operatively associated with the jib boom 125 such that the jib articulation assembly 135 follows the jib boom 125. Further the interaction between the jib boom 125 and the jib articulation assembly 135 is such that the jib articulation assembly 135 maintains the orientation of arm 150B relative to arm 150A. The articulation assembly may include any number of links and pivots to maintain the orientation between the arms 150A and 150B. Further, links may be positioned and oriented in any manner to maintain the alignment between the arms 150A and 150B. One exemplary configuration for the articulation will now be discussed in more detail.

As illustrated in FIGS. 2B and 2C, the lower link 225 and the upper link 230 are coupled to each other and to the jib boom 125 by pivoting link 235. Pivoting link 235 can be configured such that the lower link 225 and the upper link 230 are generally parallel to each other. In at least one example, the pivoting link 235 can position and maintain the lower link 225 and the upper link 230 parallel relative to each other and/or to maintain the lower link 225 and/or the upper link 230 parallel to the jib boom 125.

Accordingly, movement of the jib articulation assembly 135 can be coupled to movement of the jib boom 125. For example, as the jib boom 125 is raised, the jib boom 125 carries the pivoting link 235. As the pivoting link 235 moves with the rotation of the jib boom 125, the coupling of the lower link 225 to both the pivoting link 235 and the jib mount 200 causes the lower link 225 to rotate about pivot 210. As the lower link 225 thus rotates, the second end 225B moves both vertically and horizontally due to the rotation. The coupling between the jib boom 125 and the lower link 225 by the pivoting link 235 causes the vertical and horizontal movement of the lower link 225 to be proportional to the vertical and horizontal movement of the jib boom 125.

Movement of the upper link 230 is coupled to movement of the lower link 225 by the pivoting link 235. Accordingly, proportional movement of the lower link 225 is transmitted through the pivoting link 235 to the upper link 230. Transmitting proportional movement of the lower link 225 to the upper link 230 causes the horizontal and vertical movement of the upper link 230 to be proportional to the horizontal and vertical movement of the jib boom 125. As previously discussed, the upper link 230 is coupled to arm 150B while the jib boom 125 is coupled to the arm 150A. Accordingly, proportional movement of the upper link 230 relative to the lower link 225 results in proportional movement of the arms 150A and 150B. Proportional movement of the arms 150A and 150B can maintain the orientation of the arms 150A and 150B relative to each other. Maintaining the arms 150A and 150B at the same relative orientation maintains the orientation of the mast assembly mount 150 and thus the attached mast assembly 115 (FIGS. 1A-1C).

Accordingly, one configuration has been provided in which the lower link 225 and the upper link 230 are generally parallel to each other. In at least one example, the lower link 225 and the upper link 230 can also be generally parallel to the jib boom 125. In at least one example, the lower link 225 and upper link 230 may be generally offset from each other as well as being offset from the jib boom 125. The upper link 230 can also be a variable length link that is offset from the jib boom 125. In other examples, links may be provided on a single side of the jib boom 125 that includes at least one variable length link. In such examples, the variable length link can be offset from the jib boom 125. Further, in such examples, the link or links can move generally parallel to the jib boom 125 as the jib boom 125 rotates to raise and lower the mast assembly 115 (FIG. 1A-1C).

In yet another example, a single link may be provided that is generally parallel with the jib boom. Such a single link can be pivotingly coupled to a mount offset from the jib boom on one end and to the mast assembly mount on another end. Accordingly, various configurations can be provided by which a variable length link can be positioned at an offset relative to the jib boom while maintaining the variable length link generally parallel to the jib boom to maintain the orientation of a mast assembly mount while the jib boom is raised and lowered.

FIG. 3 illustrates a plan view of the jib assembly 110, the mast assembly mount 150, the mast slewing assembly 165, and the mast tilt cylinder 160. As previously introduced, the jib assembly 110 includes a jib slewing assembly 145. In the illustrated example, the jib slewing assembly 145 can include slewing cylinders 305A and 305B. The slewing cylinders 305A and 305B can be coupled to a stationary structure, such as the jib mount 200. Extension of slewing head 305A can be complimented by retraction of slewing head 305B to cause the rest of the jib assembly 110 to rotate about pivot 310 and thereby position the jib assembly 110 relative to the stationary structure. Slewing cylinder 305B can be similarly extended while slewing cylinder 305A is retracted to rotate the jib assembly 110 in the opposite direction.

In a similar manner, the mast slewing assembly 165 can be configured to pivot the mast carrier 152 relative to the jib assembly 110. In particular, the mast carrier 152 can be coupled to a mast slewing head 315 by way of pivot 290, illustrated in FIGS. 2A-2C. Referring again to FIG. 3, the mast slewing assembly 165 can further include a mast slewing cylinder 320. The mast slewing cylinder 320 can be secured to the mast slewing head 315 by a mount 325. The mount 325 can provide a relatively stationary base from which the mast slewing cylinder 320 can be extended and retracted to rotate the mast carrier 152.

The mast slewing cylinder 320 can be coupled to the mast carrier 152 by pivot 330. The pivot 330 allows the mast slewing cylinder 320 to rotate as they expand and retract. Rotating the mast carrier 152 relative to the mast slewing head 315 can allow the mast slewing assembly 165 to further position the mast carrier 152 relative to the jib assembly 110.

Relative extension of the jib lifter 130 (FIGS. 2A-2C) is maintained as the jib slewing assembly 145 rotates the jib boom 125. Accordingly, the jib assembly 110 can be configured such that rotation of the jib boom 125 does not change the orientation of the jib boom 125. Similarly, the mast assembly 115 (FIGS. 2A-2B) can be configured such that rotation of the mast carrier 152 by the mast slewing assembly 165 also does not change the orientation of the mast carrier 152. Accordingly, the orientation of the jib boom 125 and/or the mast carrier 152 can be maintained as the jib boom 125 and mast carrier 152 are raised and lowered as well as rotated.

As previously introduced, the jib articulation assembly 135 (FIGS. 2A-2C) can be configured to provide relatively high-pull back torque as well as to help minimize the potential for over-rotation of the mast assembly 115 as the mast assembly 115 is moved from a drilling position to a transport position. A drilling position is illustrated in FIG. 2B while a transport position is illustrated in FIG. 2A.

As previously introduced, the upper link 230 is offset from the jib boom 125. As illustrated in FIGS. 2A and 2B, a relatively short change in length of the upper link 230 may be used to move the mast assembly 115 from the drilling position to the transport position. A relatively short variance in length may increase the torque the upper link 230 exerts on the mast assembly mount 150 compared to configurations in which a lifting cylinder is mounted directly to a jib boom. Further, a relatively short variance in the upper link 230 may reduce the possibility that extension of the upper link 230 can cause the upper link 230 to over-rotate the mast assembly 115 past the vertical axis 140. Accordingly, such a configuration can allow an operator to rotate the mast assembly 115 both toward and away from the rig (105, FIGS. 1A-1B) to a desired drilling angle.

Accordingly, articulation assemblies, jib assemblies, and drilling systems have been discussed herein that are configured to maintain a mast assembly at a drilling angle as the mast is raised and lowered. The mast may be raised and lowered to allow the drilling rig or drilling system to be moved. Accordingly, the drilling angle may be maintained as the drilling system or rig is moved between drilling locations on a job site where the same drilling angles are being used. The articulation assembly can provide a relatively high pull-back torque, which may allow the articulation assembly to readily move the mast assembly to a transport position. Further, the configuration of the articulation assembly may reduce the possibility that the drill mast will be over-rotated, thereby increasing the stability of the drilling system.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A jib assembly for use with a drill rig, comprising:

a jib boom having a first end and a second end, said jib boom being configured to rotate about said first end of said jib boom, and wherein said second end of said jib boom is configured to be coupled to a mast assembly mount; and an articulation assembly having at least one variable length link, said at least one variable length link having a first end and a second end, said first end of said articulation assembly being offset from said jib boom, and wherein said second end of said articulation assembly is configured to be pivotingly coupled to the mast assembly mount;

wherein said articulation assembly includes an upper link, a lower link, and a pivoting link coupling said upper link and said lower link, wherein said pivoting link is further pivotingly coupled to said jib boom, and wherein said lower link and said upper link are parallel relative to each other, and wherein at least one of said upper link and said lower link includes said at least one variable length link.

2. The jib assembly of claim 1, wherein said at least one variable length link is parallel to said jib boom.

3. The jib assembly of claim 1, wherein said lower link and said upper link are adapted to remain parallel relative to each other during the raising and lower of said mast assembly mount.

4. The jib assembly of claim 3, wherein said upper link includes said at least one variable length link.

5. The jib assembly of claim 4, wherein said upper link and said lower link are parallel to said jib boom.

6. The jib assembly of claim 5, wherein said upper link and said lower link are located on opposing sides of said jib boom.

7. The jib assembly of claim 5, wherein said mast assembly mount includes a first arm and a second arm offset from said first arm, said jib boom being configured to be coupled to said first arm and said upper link being configured to be coupled to said second arm.

8. The jib assembly of claim 1, wherein said at least one variable length link includes a hydraulic cylinder.

9. A jib assembly, comprising:

a jib boom having a first end and a second end, said first end being configured to be coupled to a jib mount, and said second end being configured to be coupled to a mast assembly mount;

an articulation assembly having at least one variable length link, said at least one variable length link being maintained parallel to a line between said first end and said second end of said jib boom, wherein said at least one variable length link is located on a first side of said jib boom; and a pivoting link coupling said at least one variable length link to said jib boom.

10. The jib assembly of claim 9, further comprising a mast slewing assembly adapted to pivot relative to said jib boom.

11. The jib assembly of claim 9, further comprising an additional link having a first end and a second end, wherein said first end of said additional link is configured to be coupled to said jib mount, and wherein said second end of said additional link is coupled to said pivoting link.

12. The jib assembly of claim 11, wherein said additional link is located on an opposing side of said jib boom from said at least one variable length link.

13. The jib assembly of claim 12, wherein said pivoting link is pivotingly coupled to said jib boom.

14. The jib assembly of claim 9, further comprising a jib lifter operatively associated with said jib boom, said jib lifter being configured to rotate said jib boom about said first end of said jib boom.

15. An assembly for positioning a drill mast, comprising:

a mast assembly mount;

a jib boom having a first end and a second end, said first end of said jib boom being coupled to a jib mount, and said second end of said jib boom being coupled to said mast assembly mount;

a jib lifter configured to rotate said jib boom about said first end of said jib boom;

a jib articulation assembly having a variable length link, said variable length link having a first end and a second end, said first end of said variable length link being offset from said jib boom, and said second end of said variable length link being coupled to said mast assembly mount such that said variable length link is parallel to a line between said first end of said jib boom and said second end of said jib boom as said jib lifter rotates said jib boom about said first end of said jib boom;

a pivoting link coupled to said first end of said variable length link; and an additional link coupled to a second end of said pivoting link.

16. The assembly of claim 15, further comprising a pivoting link coupled to said first end of said variable length link and a link coupled to a second end of said pivoting link.

17. The assembly of claim 16, wherein said pivoting link is further pivotingly coupled to said jib boom and said link is coupled to said jib mount.

18. The assembly of claim 17, wherein said link and said variable length link are positioned on opposing sides of said jib boom.

19. The assembly of claim 18, wherein said link is parallel to said variable length link.

20. The assembly of claim 18, further comprising a jib slewing assembly coupled to said jib boom.

21. The assembly of claim 15, further comprising a mast carrier coupled to said mast assembly mount.

22. The assembly of claim 21, further comprising a mast slewing assembly coupled to said mast carrier and to said mast assembly mount, said mast slewing assembly being configured to rotate said mast carrier relative to said mast assembly mount.

23. A drilling system, comprising:

a rig;

a jib assembly coupled to the rig, the jib assembly including:

a mast assembly mount, a jib boom having a first end and a second end, said first end of said jib boom being coupled to said rig, and said second end of said jib boom being coupled to said mast assembly mount, a jib lifter configured to rotate said jib boom about said first end of said jib boom, and a jib articulation assembly having a variable length link having a first end and a second end, said first end of said variable length link being offset from said jib boom, and said second end of said variable length link being coupled to said mast assembly mount such that said variable length link is parallel to a line between said first end of said jib boom and said second end of said jib boom as said jib lifter rotates said jib boom about said first end of said jib boom, a pivoting link coupled to said first end of said variable length link, and an additional link coupled to a second end of said pivoting link;

a mast coupled to said mast assembly mount; and a drill head coupled to said mast.

24. The system of claim 23, wherein said jib assembly is removably coupled to said rig.

25. The system of claim 23, further comprising a mast carrier coupled to said mast assembly mount, said mast carrier being configured to rotate said mast relative to said mast assembly mount.

26. The system of claim 25, further comprising a mast slewing assembly coupled to said mast assembly mount and said mast carrier, said mast slewing assembly being configured to rotate said mast carrier relative to said mast assembly mount.

* * * * *

UNITED STATES PATENT AND TRADEMARK OFFICE

CERTIFICATE OF CORRECTION

PATENT NO. : 7,905,299 B2
APPLICATION NO. : 12/233363
DATED : March 15, 2011
INVENTOR(S) : Wrede et al.

It is certified that error appears in the above-identified patent and that said Letters Patent is hereby corrected as shown below:

Column 3
Line 61, change “Such plane” to --Such a plane--

Column 5
Line 33, change “230” to --160--
Line 36, change “link” to --links--
Line 36, change “creating” to --created--

Column 7
Line 65, change “assembly” to --assembly 135--

Signed and Sealed this
Twenty-seventh Day of September, 2011

David J. Kappos

David J. Kappos
*Director of the United States Patent and Trademark Office*